US006361145B1

(12) United States Patent
Ishimatsu et al.

(10) Patent No.: US 6,361,145 B1
(45) Date of Patent: Mar. 26, 2002

(54) INK JET RECORDING HEAD, METHOD OF PRODUCING SAME, AND INK JET RECORDING APPARATUS

(75) Inventors: Shin Ishimatsu, Yokohama; Tsutomu Abe, Isehara; Takeshi Okazaki, Sagamihara; Kouichi Omata, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/235,769

(22) Filed: Jan. 25, 1999

(30) Foreign Application Priority Data

Jan. 27, 1998 (JP) ..... 10-013980

(51) Int. Cl.[7] ..... B41J 2/14

(52) U.S. Cl. ..... 347/47; 347/44; 347/45; 347/63

(58) Field of Search ..... 347/44, 45, 47, 347/63

(56) References Cited

U.S. PATENT DOCUMENTS

| | | | | |
|---|---|---|---|---|
| 4,313,124 A | | 1/1982 | Hara | 346/140 R |
| 4,459,600 A | | 7/1984 | Sato et al. | 346/140 R |
| 4,463,329 A | | 7/1984 | Suzuki | 333/239 |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 5,208,604 A | * | 5/1993 | Watanabe et al. | 347/47 |
| 5,361,087 A | * | 11/1994 | Tajima et al. | 347/44 |
| 5,365,255 A | * | 11/1994 | Inoue et al. | 347/45 |
| 6,211,486 B1 | | 4/2001 | Ishimatsu et al. | 219/121.71 |

FOREIGN PATENT DOCUMENTS

| | | | | |
|---|---|---|---|---|
| EP | 367 541 A2 | | 5/1990 | |
| EP | 419 190 A2 | | 3/1991 | |
| EP | 0419190 A2 | * | 3/1991 | B41J/2/16 |
| EP | 0495649 A1 | * | 7/1992 | B41J/2/16 |
| EP | 495 649 A1 | | 7/1992 | |
| JP | 54-56847 | | 5/1979 | |
| JP | 59-123670 | | 7/1984 | |
| JP | 59-138461 | | 8/1984 | |
| JP | 60-71260 | | 4/1985 | |
| JP | 2-121843 | | 5/1990 | |
| JP | 2-187346 | | 7/1990 | |
| JP | 10-118782 | | 5/1998 | |

* cited by examiner

*Primary Examiner*—John Barlow
*Assistant Examiner*—Manish Shah
(74) *Attorney, Agent, or Firm*—Fitzpatrick, Cella, Harper & Scinto

(57) ABSTRACT

A method of producing an ink jet recording head comprises the steps of forming a discharge port by irradiating a discharge port forming member, which is integrally provided on a top plate provided with a groove of an ink flow path communicated with the discharge port for discharging ink, and in which the discharge port is formed, with a laser beam having ununiform intensity distribution of the light beam, from the groove side and forming the ink flow path by connecting the top plate to a substrate, with the groove being positioned inside.

13 Claims, 11 Drawing Sheets

INK JET RECORDING HEAD, METHOD OF PRODUCING SAME, AND INK JET RECORDING APPARATUS

BACKGROUND OF THE INVENTION

1. Field of the Invention

The present invention relates to a method of producing an ink jet recording head, an ink jet recording head produced by the method and an ink jet recording apparatus. In particular, the present invention relates to a method of producing an ink jet recording head whose discharge port is formed by use of laser beam, an ink jet recording head produced by the method, and an ink jet recording apparatus.

2. Related Background Art

To work a discharge port (orifice) of an ink jet recording head an excimer laser beam has been recently often used. As disclosed in Japanese Patent Application Laid-Open No. 2-121843 and No. 2-187346 which corresponds to U.S. Pat. No. 5,208,604, working of an orifice by the use of excimer laser beam has been typically carried out by irradiating a discharge port forming member (orifice plate) of a top plate which integrally has a groove member in which a groove of a flow path of recording liquid (ink) was formed and a discharge port member which is positioned at the front of this groove and has a comparatively thin thickness, with excimer laser beam. Further, these Applications also disclose a method of working a taper-shaped orifice whose sectional area is gradually reduced in the discharge direction by irradiation of excimer laser from the groove side of the flow path of the top plate.

The summary of the prior art method will now be described with reference to FIGS. 6 and 7. FIG. 6 is a schematic perspective view showing a conventional ink jet recording head. FIG. 7 is a schematic cross-sectional view of FIG. 6.

In the ink jet recording head shown in FIG. 6, a substrate 602 and a top plate 608 are formed while they are connected to each other. The substrate 602 is provided with an energy generator which generates energy which is utilized for discharging ink. The ink jet recording head shown in FIG. 6 is provided with electrothermal converting elements 601 which generate thermal energy as energy generators respectively. The grooves 603 which form ink paths are formed in the top plate 608 so that they correspond to the electrothermal converting elements 601, respectively. A discharge port forming member 605 is integrally provided on the top plate 608 at the end portion of the groove 603 so that an ink discharge port 604 is communicated with the groove 603. To the ink flow path is supplied ink from a common ink chamber 606 defined with a frame 607.

A top plate is provided with a groove 701, a discharge port 702, a discharge port forming member 703, a common ink chamber 704, a frame for the ink chamber and the like. The reference numeral 707 denotes excimer laser beam irradiated for working the discharge port 702 through desired optical systems. The reference numeral 708 denotes a laser beam axis of the excimer laser beam 707. The reference numeral 709 denotes the central axis of the groove 701. Further, the reference numeral 710 denotes a straight line l obtained by connecting the center p of gravity on plane P rectangular to the central axis 709 of the groove to the center q of gravity of the discharge port on a plane Q other than the plane P rectangular to the central axis 709 of the groove.

In such working of the discharge port by use of excimer laser beam, shown in FIG. 7, the straight line l 710 is not made to be parallel to the central axis 709 of the groove so that the discharge port 702 has a tapered-shape whose sectional area is reduced in the discharge direction. Further, the laser beam axis 708 becomes the same as the straight line l 710. As the result, ink is discharged in the extended direction of the laser beam axis 708. In this connection, a recording medium surface is shown in FIG. 7, for reference.

The discharge port shown in Japanese Patent Application Laid-Open No. 2-187346 has a structure which can stably obtain the amount and discharge rate of ink droplets. However, to obtain higher-definition images in the ink jet recording head, there still remains the following problems.

Namely, the discharge port 702 has the above-mentioned structure or shape, ink droplets cannot reach the recording medium surface in the vertical direction thereto. This depends on the method of working the discharge port by the use of excimer laser shown in FIG. 7. This reason is that when the excimer laser beam 707 is radiated from a groove side of the ink flow path in the ink chamber, the excimer laser beam must be radiated at a certain angle (θ1) so that no excimer laser beam 707 reaches the frame 705 of the ink chamber. The above-mentioned Japanese Patent Application Laid-Open No. 2-187346 discloses θ1=10°. It is physically impossible to have condition θ1=0° without the irradiation of the frame 705 of the ink chamber with excimer laser beam 707. On the other hand, when the frame 705 of the ink chamber is irradiated with excimer laser beam 707, no discharge port can be worked. A method of providing the frame 705 of an ink chamber later is considered so that the condition θ1=0° can be obtained. However, it is actually impossible to strongly and positively adhere the frame 705 of the ink chamber, which is a minute portion, without imparting change to ink and with adhesive having resistance to ink.

Thus, there are no ways other than discharging ink droplets at the angle θ1 of the laser beam axis from the discharge port using the working method described in Japanese Patent Application Laid-Open No. 2-187346. As mentioned above, since the θ1 always has an angle larger than 0°, there are no ways other than tilting a top plate or recording medium to cause the ink droplets to reach the recording medium surface in the vertical direction thereto. Further, any method thereof has complicated and large-scale configuration, it is not always an appropriate means.

Next, the reason why obtaining high-definition images is impossible when ink droplets cannot vertically arrive at the recording medium surface, will be described. FIG. 8 is a schematic view showing the state of arrival of the ink droplets at the recording medium surface (paper surface). In FIG. 8 the reference numeral 801 denotes an ink droplet A discharged at a certain angle θ1 and the numeral 802 denotes an ink droplet B discharged without having a certain angle θ1. The reference numeral 803 denotes an ideal recording medium A, and the numeral 804 denotes an actual recording medium B. The reference numeral 805 denotes the arrival position A where the ink droplet A 801 discharged at a certain angle θ1 arrives at the ideal recording medium A 803, 806 denotes the arrival position B where the ink droplet A 801 discharged at a certain angle θ1 arrives at the actual recording medium B 804, 807 denotes the arrival position C where the ink droplet B 802 discharged without having a certain angle θ1 arrives at the ideal recording medium A 803, and 808 denotes the arrival position D where the ink droplet B 802 discharged without having a certain angle θ1 arrives at the actual recording medium B 804.

The actual recording medium B 804 has a flexible shape, which is different from the ideal recording medium A 803.

When an ink droplet like the ink droplet A 801 arrives at the recording medium at a certain angle, difference occurs between the arrival position A 805 of the ink droplet and the arrival position B 806 thereof by the flexibility of the recording medium B 804 (in X direction in FIG. 8). However, when an ink droplet like the ink droplet 802 arrives at the recording medium without having a certain angle, even though the recording medium B 804 has flexible curved surfaces, there is no difference between the ink droplet arrival position C 807 and the ink droplet arrival position D 808. The above-mentioned points are important to attain a higher definition printing in the ink jet recording.

SUMMARY OF THE INVENTION

One object of the present invention is to provide a method of producing an ink jet recording head which can attain a high-definition image recording easily and at a low cost, an ink jet recording head produced by the production method, and an ink jet recording apparatus.

Another object of the present invention is to provide a method of producing an ink jet recording head comprising the steps of:

forming a discharge port by irradiating a discharge port forming member, which is integrally provided on a top plate provided with a groove of an ink flow path communicated with said discharge port for discharging ink, and in which said discharge port is formed, with a laser beam having ununiform intensity distribution of the light beam, from said groove side; and forming said ink flow path by connecting said top plate to a substrate, with said groove being positioned inside.

Still another object of the present invention is to provide an ink jet recording head, in which an ink flow path is formed by connecting a top plate integrally having a discharge port forming member in which a discharge port for discharging ink is formed, and which is provided with a groove of said ink flow path communicated with said discharge port, to a substrate, with said groove positioned inside;

wherein said discharge port is formed by irradiating said discharge port forming member with a laser beam having ununiform intensity distribution of the light beam, from said groove side, and wherein if the centers of gravity of the configuration obtained by cutting said discharge port forming member by two planes P and Q rectangular to the central axis of said groove are defined as p and q, respectively, the straight line l formed by connecting the center p of gravity to the center q of gravity is substantially parallel to the central axis of said groove.

Still another object of the present invention is to provide an ink jet recording apparatus including such ink jet recording head and a member on which said ink jet recording head is placed.

According to the present invention, the direction of ink which flows in the flow path can be caused to coincide with the direction of ink which flows in the discharge port, whereby the flow of ink can be stabilized and ink can be efficiently and stably discharged.

In an ink jet recording head of the present invention, preferably, the straight line formed by connecting the center p of gravity to the center q of gravity is substantially vertically intersected to the outer surface of the discharge port forming member. Accordingly, an ink jet recording head of the present invention can prevent the effects of change of minute wettability having the discharge forming member, and can further stably discharge ink.

Further, in a method of producing an ink jet recording head of the present invention, a discharge port configuration which can discharge ink without depending on the laser beam axis can be produced with a laser beam through a mask, easily and at a low cost. According to the present invention, ink can be discharged without relation to the axis of laser beam by which a discharge port can be worked. As the result, ink can be discharged in a desired direction without tilting the recording medium or ink jet recording head.

Further, according to the present invention, ink can arrive at the recording medium in vertical direction thereto. Therefore, an ink jet recording head which is not influenced by cockling in the transportation of the recording medium can be produced and a high-definition image can be recorded. At the same time, the axis of the groove can be in substantially parallel to the axis of the orifice and ink can be stably discharged. Further, according to the present invention, working of the ink jet recording head is easy and the working accuracy is stabilized. As the result, an ink jet recording head which can record a high-definition image can be provided at a low cost and on a mass production.

DETAILED DESCRIPTION OF THE PREFERRED EMBODIMENTS

First Embodiment

Figure 1:
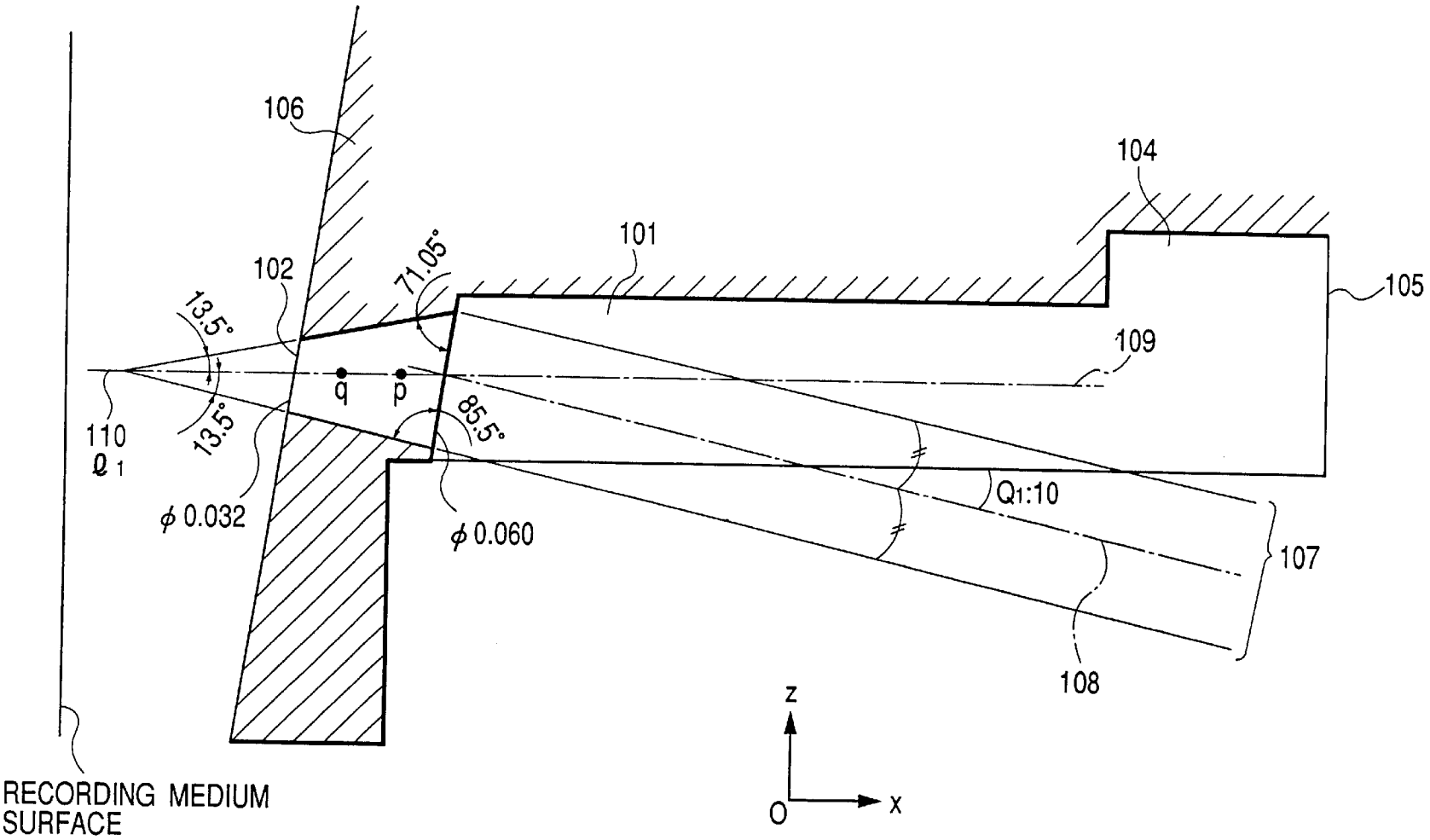
FIG. 1 is a schematic cross-sectional view showing an ink jet recording head according to a first embodiment of the present invention.
Figure 2:
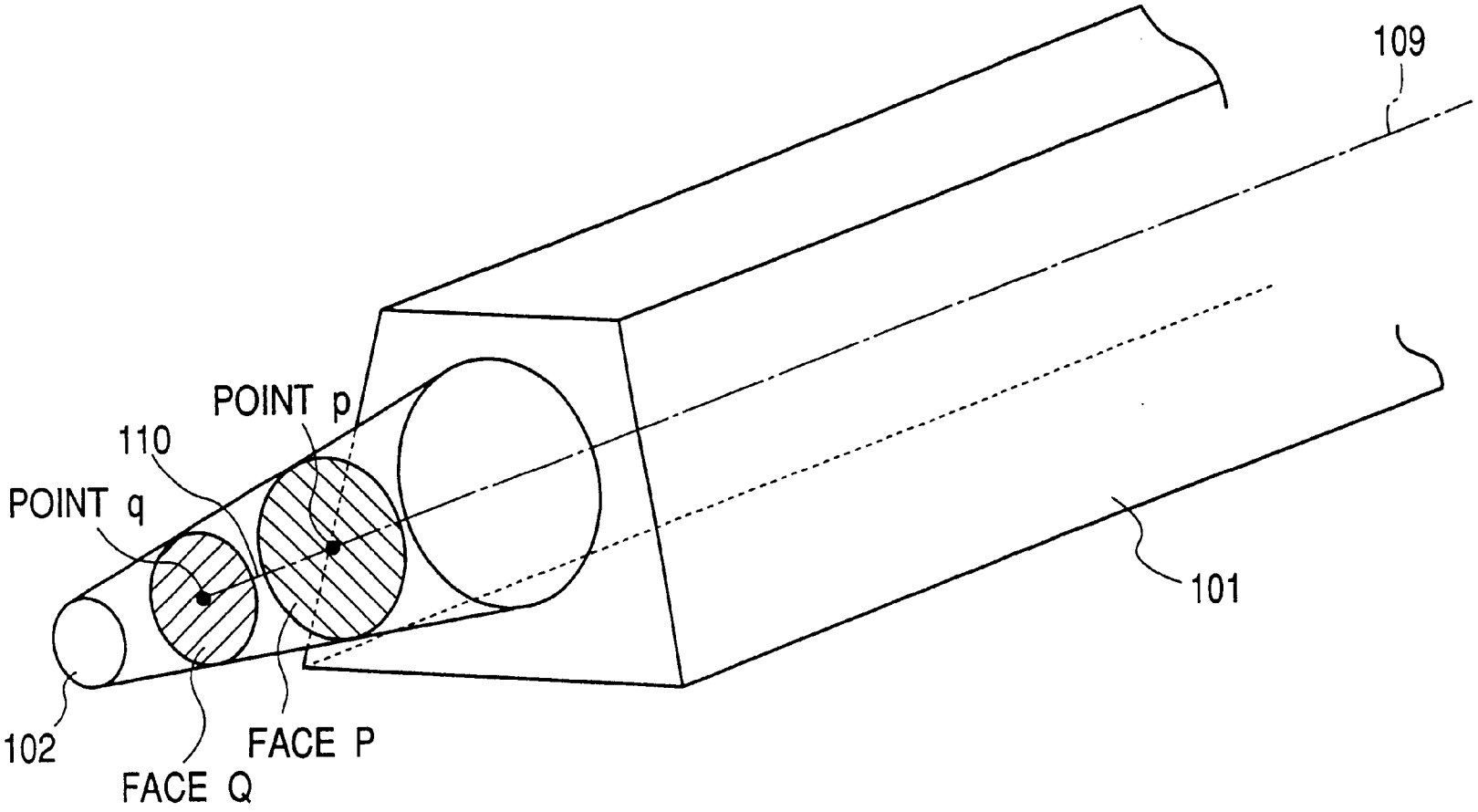
FIG. 2 is a schematic perspective view for explaining the ink jet recording head shown in FIG. 1.

FIG. 1 is a schematic cross-sectional view showing an ink jet recording head according to a first embodiment of the present invention. In FIG. 1 only a single groove portion of grooves, which are generally arranged in an ink jet recording head, is shown by the side sectional view. FIG. 2 is a schematic perspective view for explaining the ink jet recording head shown in FIG. 1. In FIG. 2, planes P and Q, points p and q, a straight line l, the central axis of a groove, and the like are exaggeratedly shown for clarification.

In FIGS. 1 and 2, a top plate 106 is provided with a groove 101, a discharge port 102, a discharge port forming member 103, a recess portion of a common chamber 104, a frame 105 of the ink chamber 104, and the like. The reference numeral 107 denotes an excimer laser beam irradiated for working the discharge port through desired optical systems not shown. The reference numeral 108 denotes a laser beam axis of the excimer laser beam 107, and the numeral 109 denotes the central axis of the groove 101. Further, the reference numeral 110 denotes a straight line l formed by connecting a center p of gravity of the section of a groove, taken along the plane P rectangular to the central axis of the groove, to a center q of gravity of the section of a discharge port, taken along the plane Q other than the plane P rectangular to the central axis of the groove.

Figure 6:
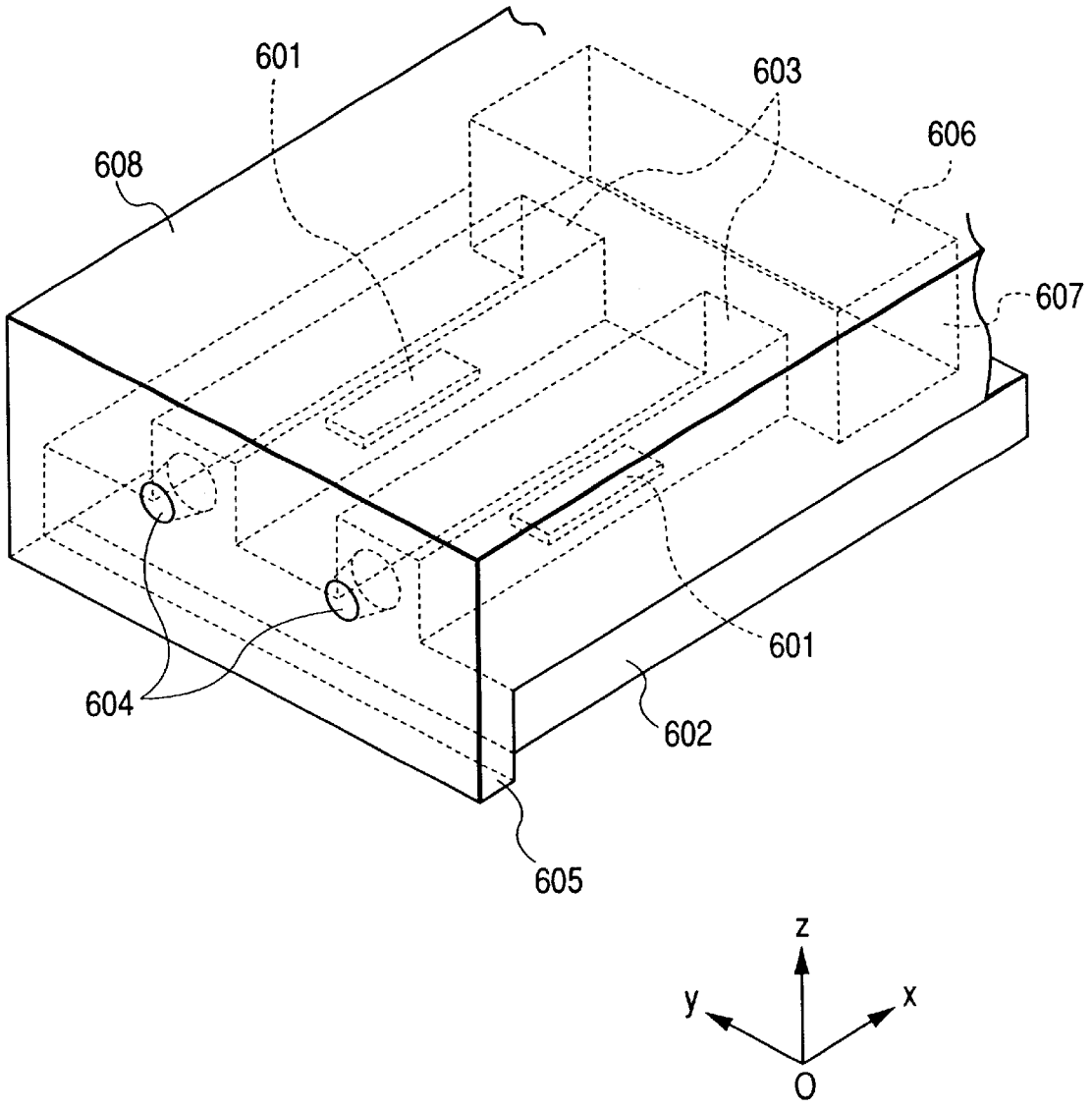
FIG. 6 is a schematic perspective view showing a conventional ink jet recording head.
Figure 7:
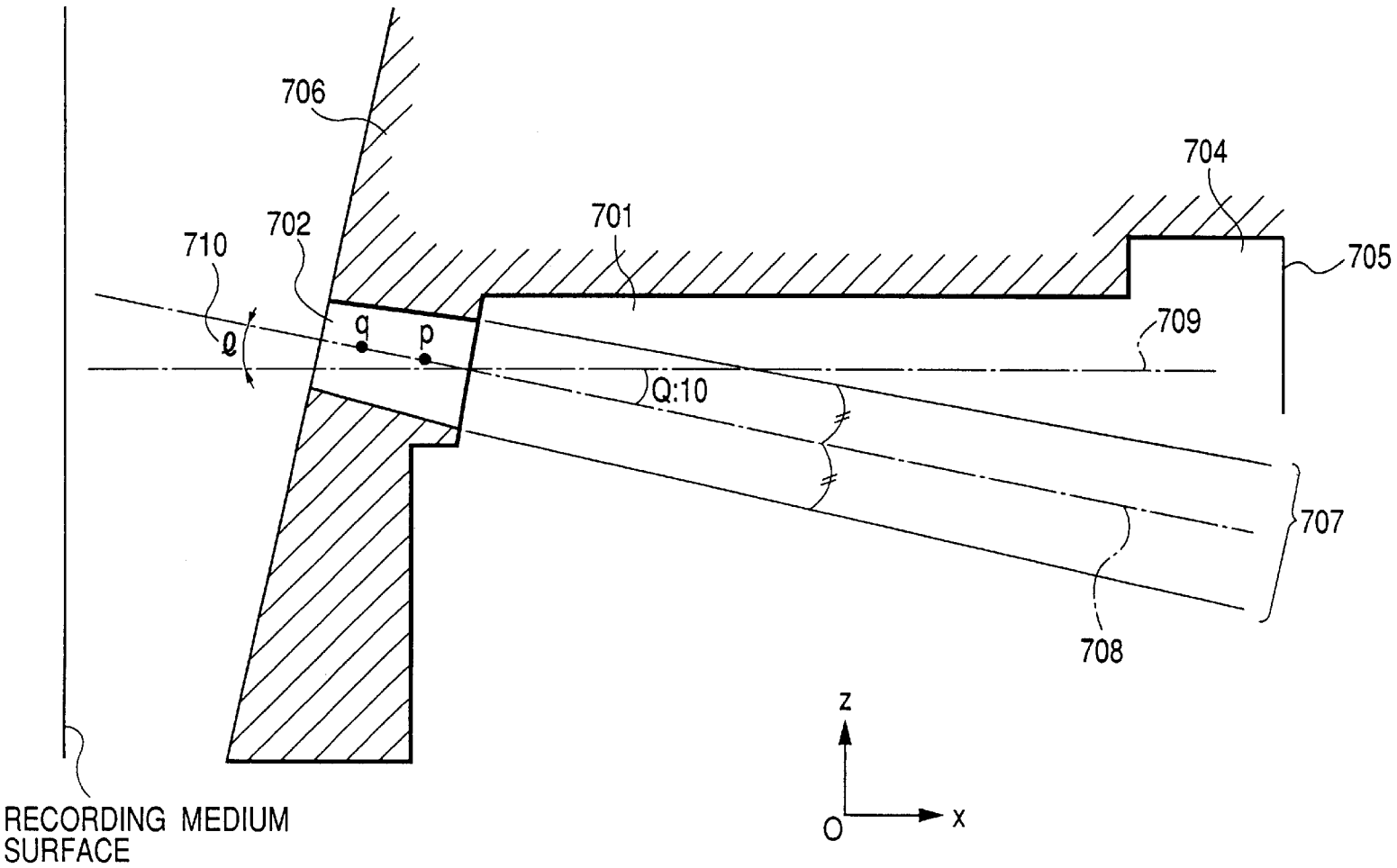
FIG. 7 is a schematic cross-sectional view showing a conventional ink jet recording head.
Figure 8:
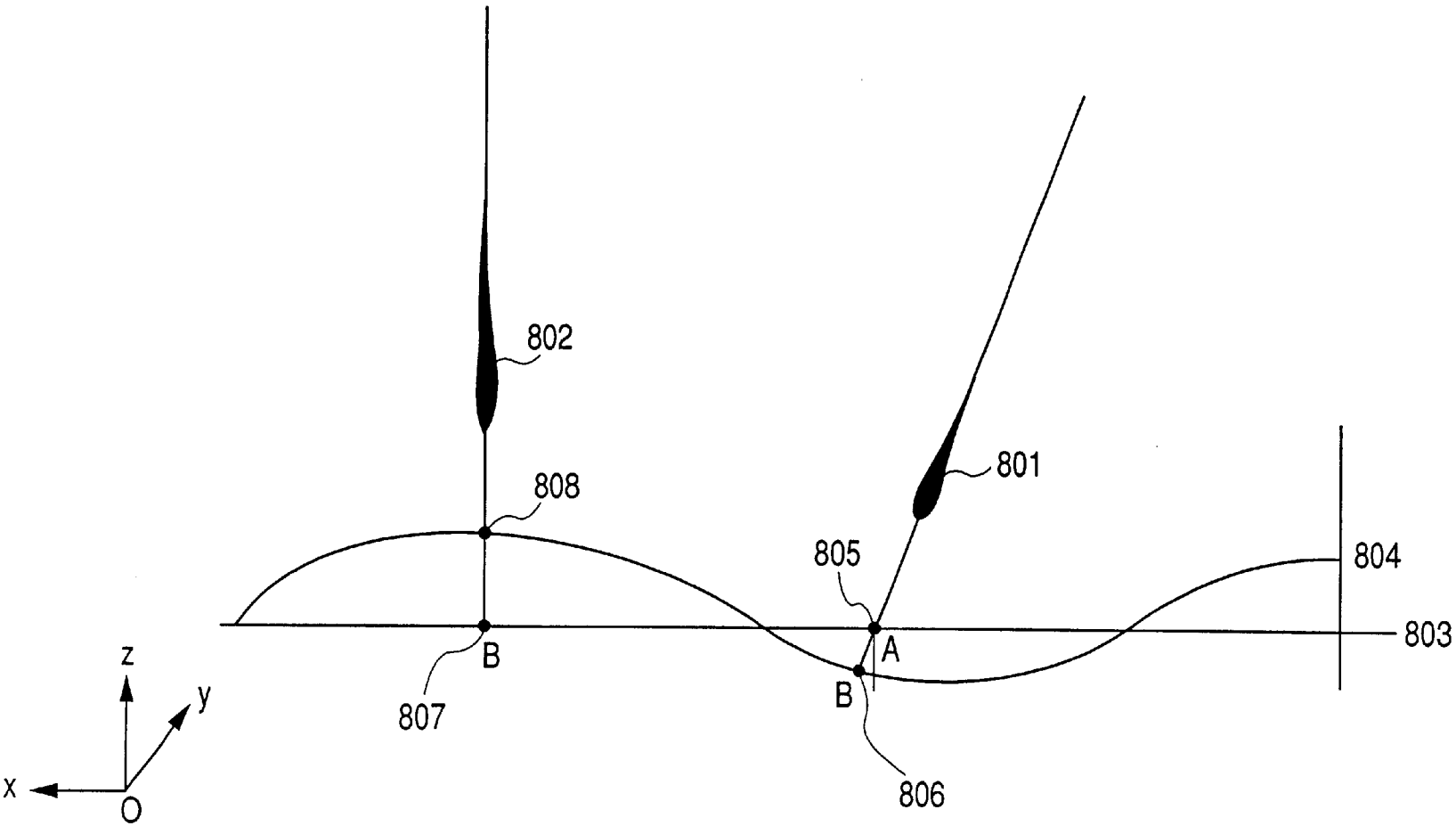
FIG. 8 is a schematic view showing the state of arrival of ink droplets at the recording medium surface.

In the first embodiment shown in FIG. 1, since the straight line l 110 is parallel to the central axis 109 of the groove, the direction of ink which flows in the flow path can be caused to coincide with the direction of ink which flows in the discharge port, whereby the flow of ink can be stabilized and ink can be efficiently and stably discharged. A schematic configuration of completed ink jet recording head may be the same as shown in FIG. 6.

Figure 3B:
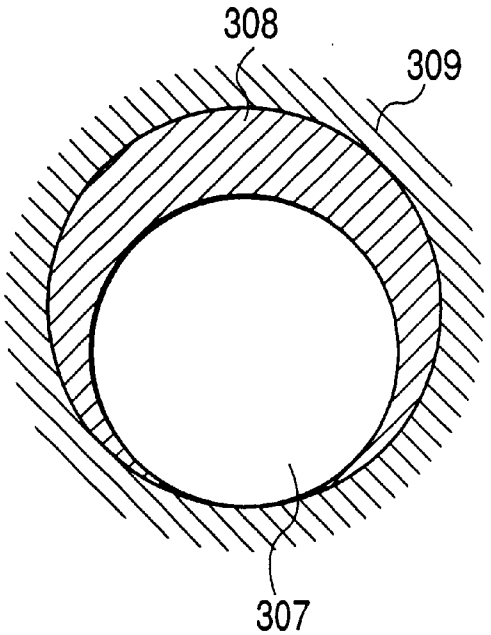
FIGS. 3A and 3B are a schematic constitutional view showing a laser working apparatus used in the present invention and a schematic view showing a mask used in the laser working apparatus, respectively.
Figure 3A:
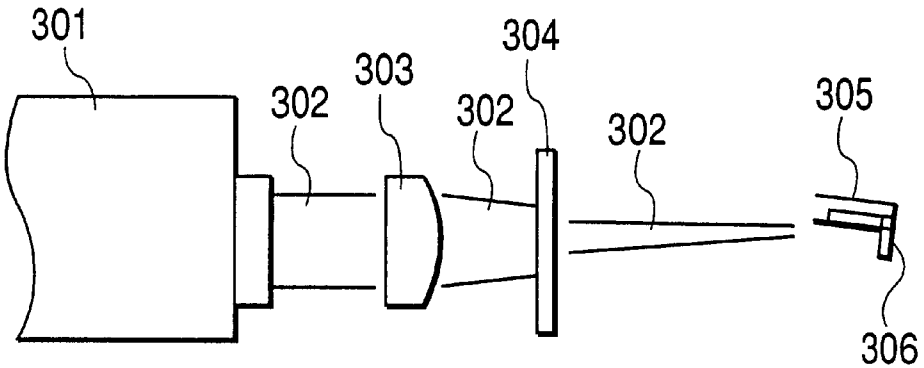

A method of working the discharge port 102 having this configuration will be described with reference to FIGS. 3A and 3B. FIGS. 3A and 3B are a schematic constitutional view showing a laser working apparatus used in the present invention and a schematic view showing a mask used in the laser working apparatus, respectively.

In FIGS. 3A and 3B, the reference numeral 301 denotes a laser oscillation device which oscillates a Kr—F excimer laser beam or the like, 302 a laser beam oscillated from the oscillation device 301, 303 a lens for focusing a laser beam 302, and 304 a mask which is provided with a desired pattern for defining discharge ports and can partially shield a laser beam 302. The reference numeral 305 denotes a top plate which is worked by the laser beam 302 through the mask 304 and the numeral 306 denotes a discharge port forming member in which a plurality of discharge ports are worked. Further, the reference numeral 307 denotes a pattern, which defines a pattern of the shape of a discharge port, and also denotes a portion through which the laser beam 302 is transmitted but not shielded, 308 a pattern for controlling the shape of the taper of the discharge port and a light shielding portion for obtaining a desired amount of laser beam, and 309 a light shielding portion through which the laser beam is not transmitted. Ununiform intensity distribution of a laser beam irradiated is obtained by such mask.

A discharge port configuration which can discharge ink without depending on the laser beam axis can be produced easily and at a low cost by the use of the laser working apparatus and laser mask pattern shown in FIGS. 3A and 3B.

Second Embodiment

In the first embodiment shown in FIG. 1, the straight line l 109 does not intersect vertically to the outer surface of the discharge port forming member 103, but it merely coincides with the central axis 109 of the groove. According to this configuration, the ink jet recording head could discharge ink in the direction of the straight line l09 without relation to the laser beam axis 108. However, in a case where ink having a high viscosity is discharged, ink sometimes discharges in a direction deviated from that direction of the straight line l09 at a very small frequency.

Figure 4:
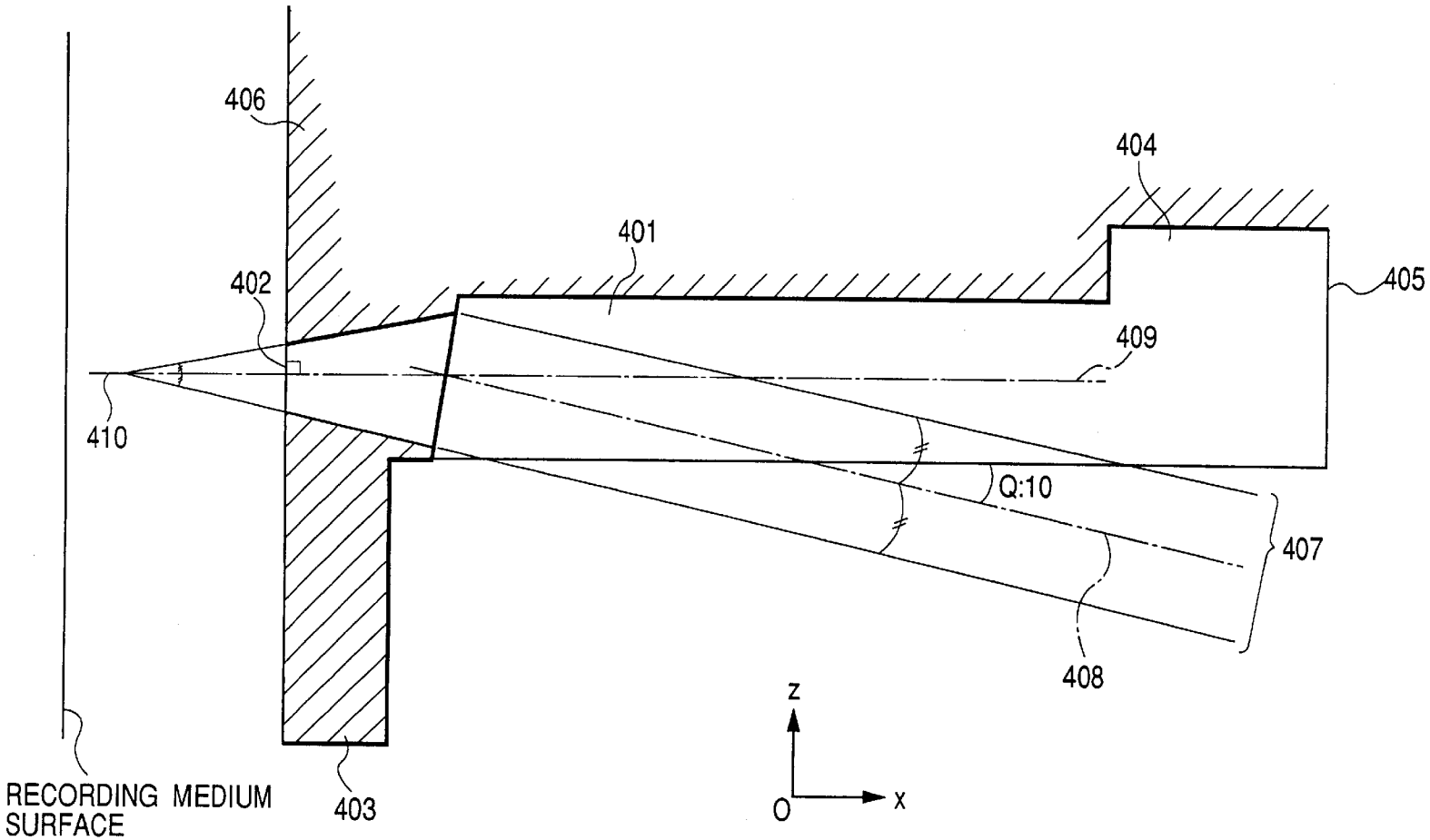
FIG. 4 is a schematic cross-sectional view showing an ink jet recording head according to a second embodiment of the present invention.

Thus, in the second embodiment shown in FIG. 4, a configuration that can discharge ink stably is used. FIG. 4 is a schematic cross-sectional view showing an ink jet recording head according to a second embodiment of the present invention. In FIG. 4, a top plate 406 is provided with a groove 401, a discharge port 402, a discharge port forming member 403, a recess portion of a common chamber 404, a frame 405 of the ink chamber 404, and the like. The reference numeral 407 denotes an excimer laser beam irradiated for working the discharge port through desired optical systems not shown. The reference numeral 408 denotes a laser beam axis of the excimer laser beam 407, and the numeral 409 denotes the central axis of the groove 401. Further, the reference numeral 410 denotes a straight line l formed by connecting a center p of gravity of the section of a groove, taken along the plane P rectangular to the central axis of the groove, to a center q of gravity of the section of a discharge port, taken along the plane Q other than the plane P rectangular to the central axis of the groove. The straight line l 410 is parallel to the central axis 409 of the groove and substantially vertically intersects with the outer surface of the discharge forming member 403.

In the second embodiment shown in FIG. 4, since the straight line l substantially vertically intersects with the outer surface of the discharge forming member 403, an ink jet recording head of the present invention can prevent the effects of change of minute wettability having the discharge forming member, and can further stably discharge ink.

Third Embodiment

Figure 5:
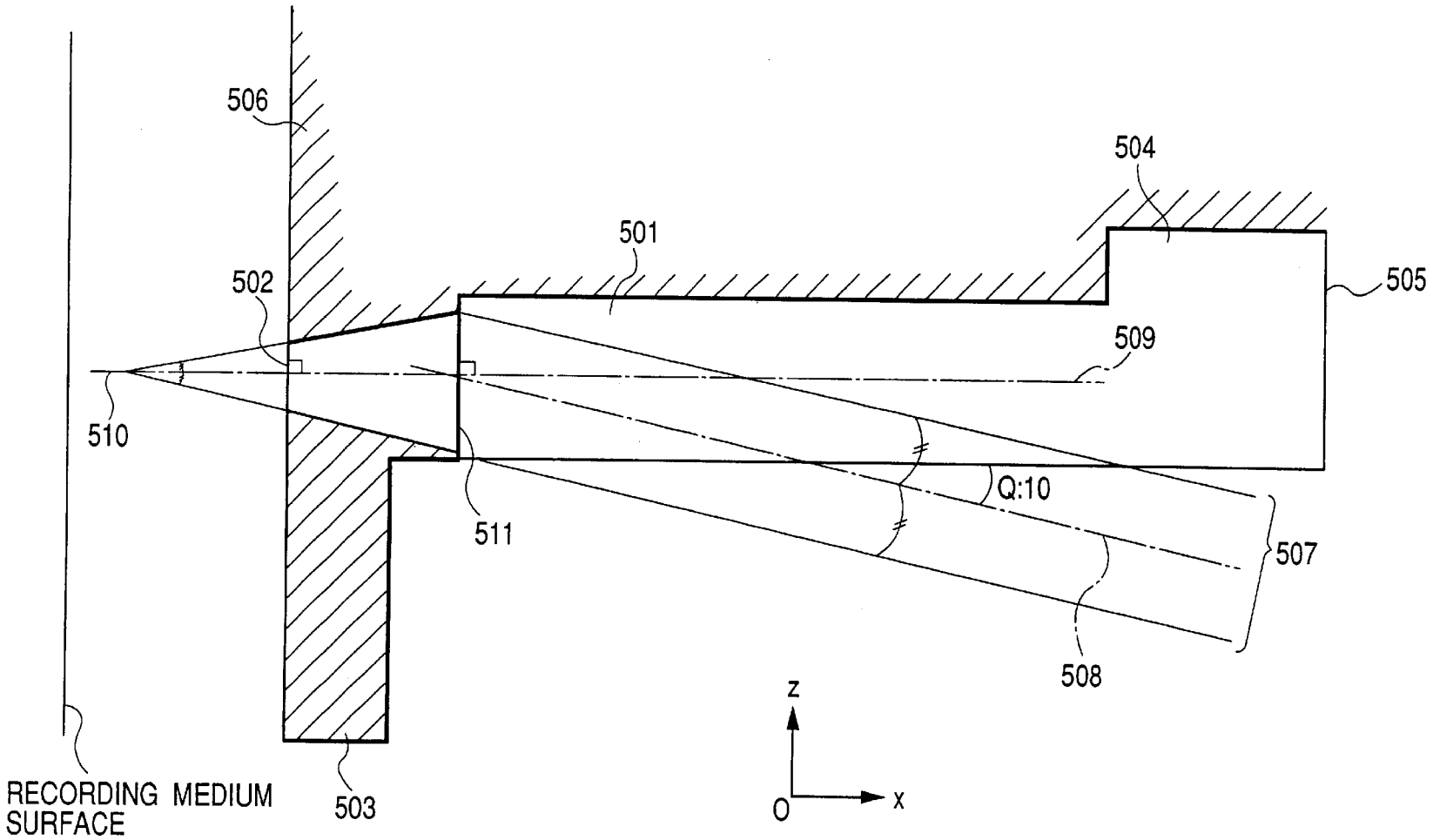
FIG. 5 is a schematic cross-sectional view showing an ink jet recording head according to a third embodiment of the present invention.

A third embodiment shown in FIG. 5 uses a configuration in which the discharge direction is further stabilized even in high speed printing. FIG. 5 is a schematic cross-sectional view showing an ink jet recording head according to the third embodiment of the present invention. In FIG. 5 a top plate 506 is provided with a groove 501, a discharge port 502, a discharge port forming member 503, a common ink chamber 504, a frame 505 of the ink chamber and the like. The reference numeral 507 denotes an excimer laser beam irradiated for working the discharge port 502 through desired optical systems not shown. The reference numeral 508 denotes a laser beam axis of the excimer laser beam 507, and the numeral 509 denotes the central axis of the groove 501. Further, the reference numeral 510 denotes a straight line l formed by connecting a center p gravity of the section of a groove, taken along the plane P rectangular to the central axis of the groove, to a center q of gravity of the section of a discharge port, taken along the plane Q other than the plane P rectangular to the central axis of the groove, and the numeral 511 denotes a surface where a discharge port of the groove, in which the discharge port 502 is worked, is formed.

The straight line l 510 is parallel to the central axis 509 of the groove and substantially vertically intersects with the outer surface of the discharge port forming member 503. Further, the straight line l 510 also vertically intersects with the surface 511 where the discharge port of the groove is formed.

The third embodiment shown in FIG. 5 has a configuration in which the straight line 510 formed by connecting the center p of gravity to the center q of gravity, vertically intersects with surface 511 where the discharge port 502 of the groove 501 is formed. Therefore, the discharge direction is further stabilized even in a high-speed printing.

Although typical embodiments were shown above, the present invention is not limited thereto. For example, the shape of the discharge port is not limited to a circle, and the present invention has the same effects even though the shape of the discharge port is a square or the like. Further, in working the discharge port an ultraviolet laser such as Xe—Cl excimer laser etc., other than Kr—F excimer laser can be also used. Alternatively, four-dimensional harmonic of YAG laser beam, basic wave of YAG laser beam, two-dimensional harmonic of YAG laser beam, mixing wave of basic wave of YAG laser beam, two-dimensional harmonic of YAG laser beam, nitrogen gas laser beam and the like can be used. Alternatively, as an energy generator, a piezoelectric element for example, other than an electrothermal converting element may be used.

Further, in an ink jet recording head of the present invention, to obtain a high-definition image it is not necessarily required that the straight line l is parallel to the central axis of the groove. If ink arrives at a portion of the recording medium, which is within the permissible error, some angles between the straight line and the central axis of the groove can be permissible. Namely, the deviated angle therebetween from their parallel state is within 1.8°, problems do not arise in actual printing. However, preferably the straight line is parallel to the central axis of the groove in design.

Examples of the present invention will be described below.

EXAMPLE 1

In Example 1, the ink jet recording head of the first embodiment described above was produced as follows.

Polysulfone was used as a material of the top plate 106, and a common chamber 104 and 128 grooves 101 were formed by an injection molding process. The size of the groove is 0.38 mm (direction of x)×0.061 mm (direction of y)×0.070 mm (direction of z). The 128 grooves were formed by 0.0705 mm pitches in the direction of y. The directions of x, y and z are shown in FIG. 6.

Further, as a laser oscillation device 301, a device that can oscillate 248 nm Kr—F excimer laser was used. As a mask 304 a chromium-deposited synthetic quartz mask was used. The light shielding portion 309 of the mask 304 had vapour-deposited chromium and the light transmission portion 307 thereof had no vapour-deposited chromium and still remained the synthetic quartz. The light-reducing portion 308 has small pieces of square shaped chromium having one side of 0.002 mm. The light-reducing portion 308 of the laser beam 302 is used with one having a gradually increasing light transmission from 40% to 99% in the vicinity of the light transmission portion 307. The configuration of this light-reducing portion 308 was the same as in Japanese Patent Application Laid-Open No. 10-118782.

By irradiating the discharge port forming member 306 with 40 pulse laser beam having 1 j/cm$^2$ puls on a work, a top plate 106 having 128 nozzles shown in FIG. 1 could be obtained. After that this top plate was connected with a substrate 602 to obtain an ink jet recording head shown in FIG. 6.

By using the ink jet recording head, ink was actually discharged. As the result, ink was discharged in a direction of the central axis of the groove (that is the direction of the straight line l 110) without relation to the axis of the excimer laser beam. On the other hand, when an ink jet recording head having a conventional nozzle shown in FIG. 5 was used, ink was discharged in the same direction as the axis of the excimer laser beam. Further, in the ink jet recording head of Example 1, the ink discharge rate was further stabilized as compared to the conventional case.

Ink was caused to arrive at the recording medium vertically thereto while having a distance of 1 mm between the discharge port and the recording medium, so that image printing of 360 dpi was performed. As the result a high-definition image having no unevenness in the ink concentration could be obtained.

EXAMPLE 2

In Example 2, an ink jet recording head of the second embodiment described above was produced. That is the ink jet recording head was obtained by forming the discharge port 402 by the use of such laser oscillation device as shown in FIG. 3, in the same manner as in Example 1 except that the straight line l was provided so that it vertically intersects with the outer surface of the discharge port forming member 403.

When ink was actually discharged by this ink jet recording head, the discharge direction of the ink was the direction of the central axis 409 of the groove (that is the direction of the straight line l 410), which has no relation to the axis 408 of the excimer laser beam. The ink jetting accuracy and stability were further increased as compared to the ink jet recording head of Example 1, whereby even ink having a high viscosity could be stably jetted. Further, when printing was performed so that ink was caused to vertically arrive at a paper in the same manner as in Example 1, a high-definition image having no unevenness in the ink concentration could be obtained.

Further, Example 2 was further improved than Example 3 which will be described later in the production yield in the injection molding.

EXAMPLE 3

In Example 3, an ink jet recording head of the second embodiment described above was produced. That is the ink jet recording head was obtained by forming the discharge port 402 by the use of such laser oscillation device as shown in FIG. 3, in the same manner as in Example 1 except that the straight line l 501 was provided so that it vertically intersects with the outer surface of the discharge port forming member 503 and that it also vertically intersects with the surface 511 where a discharge port is formed.

When ink was actually discharged by this ink jet recording head, the discharge direction of the ink was the direction of the central axis 509 of the groove (that is the direction of the straight line l 510), which has no relation to the axis 508 of the excimer laser beam. The ink jetting accuracy and stability were further increased as compared to the ink jet recording head of Example 1, whereby even ink having a high viscosity could be stably jetted. Further, when printing was performed so that ink was caused to vertically arrive at a paper in the same manner as in Example 1, a high-definition image having no unevenness in the ink concentration could be obtained.

The straight line l was caused to be parallel to the central axis of the groove in the above-described Examples 1 to 3. However, even if an ink jet recording head having a deviated angle of 1.8° or less between the straight line and the central axis of the groove was produced, actual printing had no problems in the formation of images.

Recording Apparatus

Figure 9:
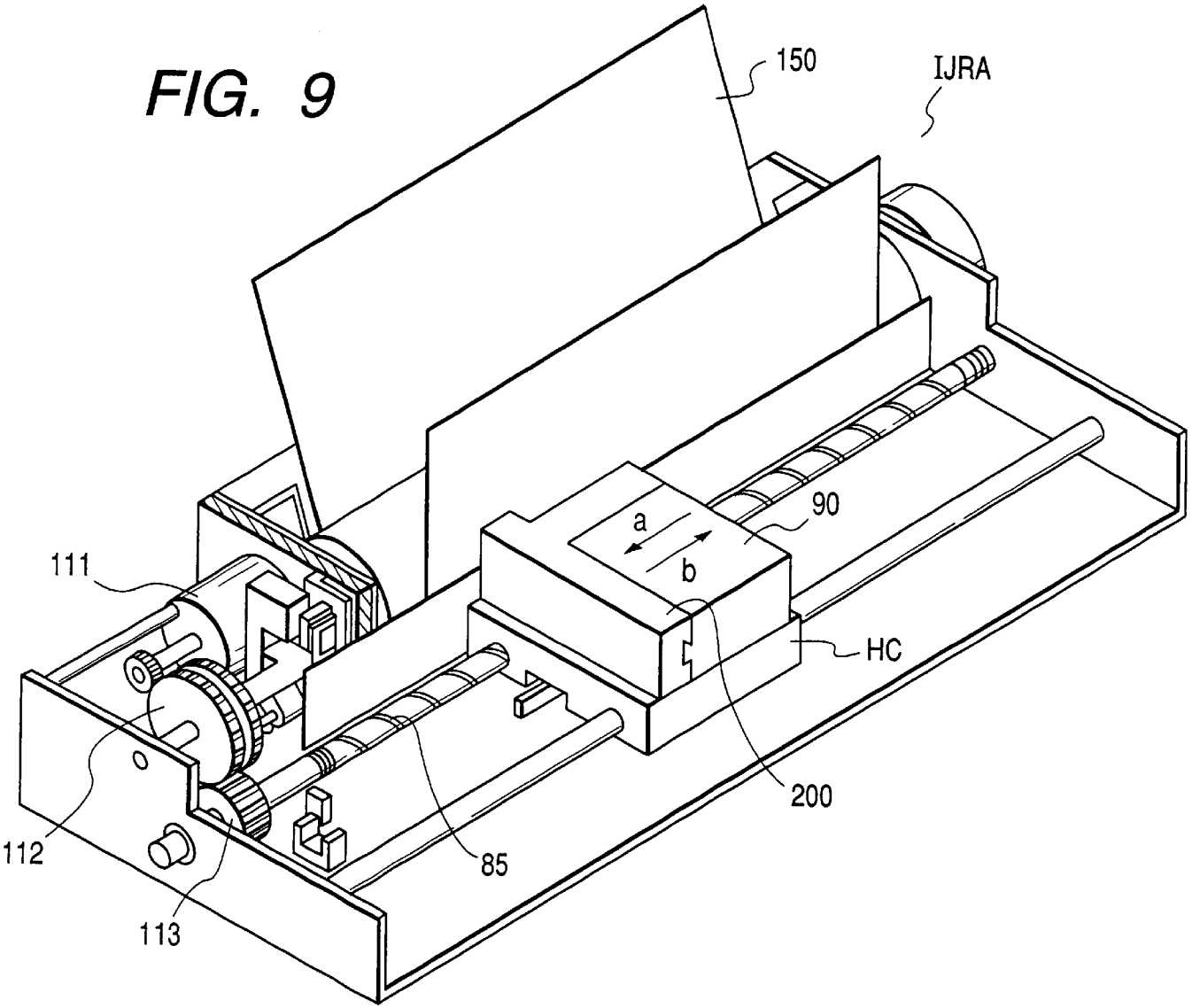
FIG. 9 is a schematic perspective view showing a main portion of an ink jet recording apparatus provided with an ink jet recording head.

FIG. 9 shows a schematic configuration of a liquid discharge device including the above-described liquid discharge head. This embodiment will be explained by use of an ink discharge recording or printing apparatus (IJRA) using ink as a discharge liquid. A carriage HC of the liquid discharge device includes a head cartridge having a detachable liquid vessel 90 which receives ink and a detachable liquid discharge head section 200. The cartridge HC is reciprocated in width directions (arrows a and b in FIG. 11) of a recording medium 150, such as a paper and the like which are fed with a recording medium feeding means.

In FIG. 9, when a driving signal is supplied from a driving signal supply means (not shown) to a liquid discharge means on the carriage HC, a recording liquid is discharged from the liquid discharge head section 200 to the recording medium 150 in response to this driving signal.

The liquid discharge device of the present examples includes a motor which is used as a driving source for driving the recording medium feeding means and the carriage HC, gears 112 and 113 for transmitting a power from the driving source, to the carriage HC, and a carriage shaft 85 and the like. By using the recording device and liquid discharge method according to the present invention, a liquid is preferably discharged to various recording medium and improved printed image could be obtained.

Figure 10:
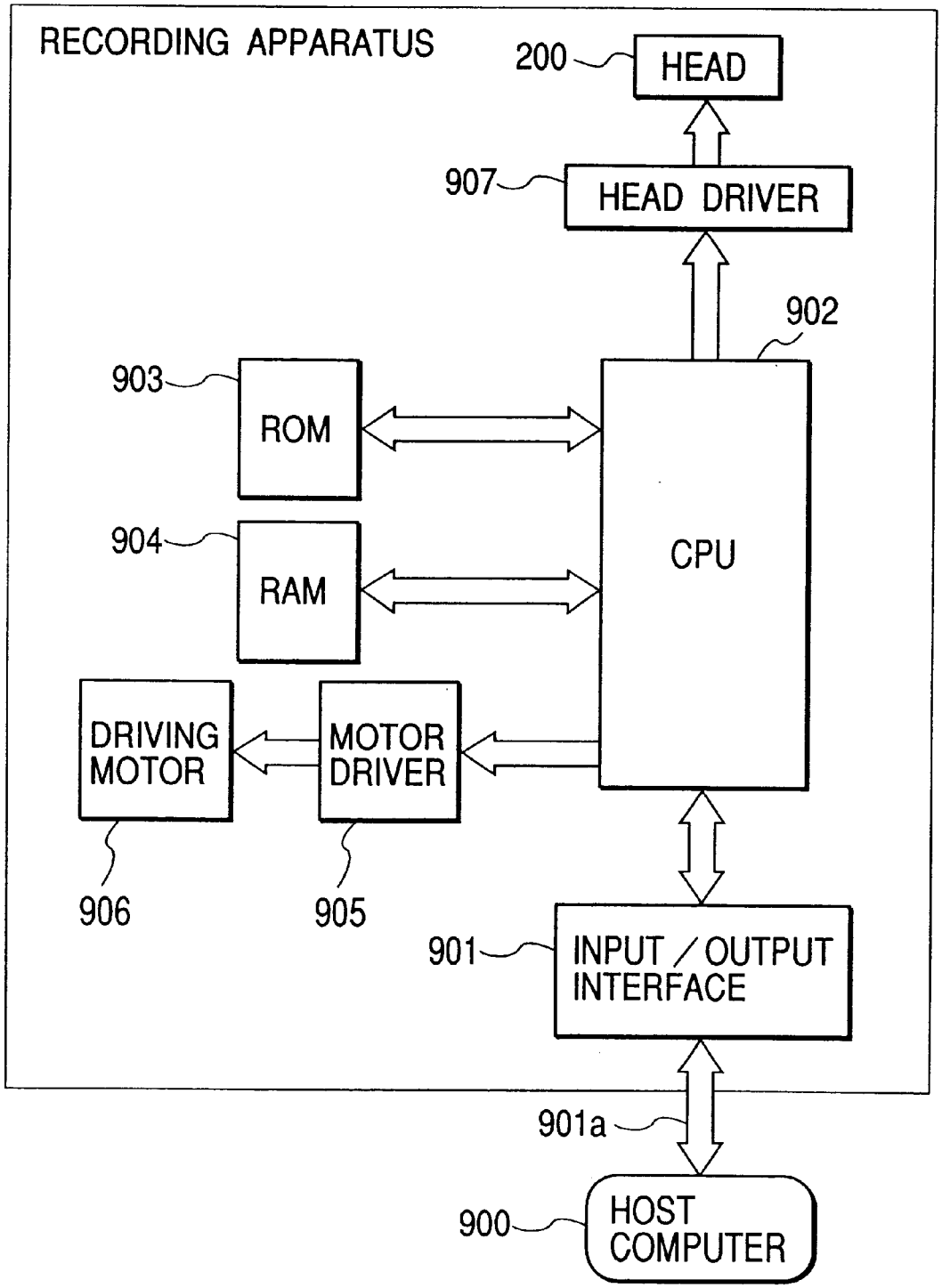
FIG. 10 is a block diagram of an ink jet recording apparatus according to the present invention.

FIG. 10 is a block diagram of the entire apparatus for operating a liquid discharge head-applied ink discharge recording device according to the present invention. The recording apparatus receives printing information from a host computer as a control signal. When the printing information is once conserved into an input/output interface 901 in a printing device, it is simultaneously converted to processable data in the recording apparatus and input to a CPU 902 which also functions as a head driving signal supply means. The CPU 902 is processed by use of a peripheral unit, such as RAM 904 etc. based on a control program conserved in a ROM 903, and is converted to image data to be printed.

The CPU 902 prepares driving data for driving a driving motor 906 which is synchronized with image data and moves a recording paper and the head 200 so that the image data is recorded at proper positions on the recording paper. The image data and the motor driving data are transferred to the head 200 and the driving motor 906 through the head driver 907 and the motor driver 905, respectively, and are driven at respectively controlled timing to make images.

As recording medium which can be applied to the above-described recording apparatus and to which ink or the like is imparted, various type papers, an OHP sheet, plastic materials used as a compact disk, a decorative plate etc., clothes, metallic materials such as aluminum, copper and the like, leather materials, such as a cow skin, a pig skin, an artificial skin etc., wood such as a tree, a plywood and the like, bamboo materials, ceramics materials such as a tile and the like, and three-dimensional structure such as sponge and the like, can be used.

The above-described recording apparatus includes a printer device which uses various type papers, an OHP sheet and the like, a plastic recording device which records on images plastic materials such as a compact disk and the like, a metal recording device which records images on a metallic plate, a leather recording device which records images on a leather material, a wood recording device which records images on a wood material, a ceramics recording device which records images on a ceramics material, a recording device which records images on three-dimensional structure such as sponge and the like, and a printing equipment which records images on a cloth material, and the like.

As a discharge liquid which is used in these liquid discharge device, a liquid which is suitable for the respective recording mediums and recording conditions may be used.

Recording System

Figure 11:
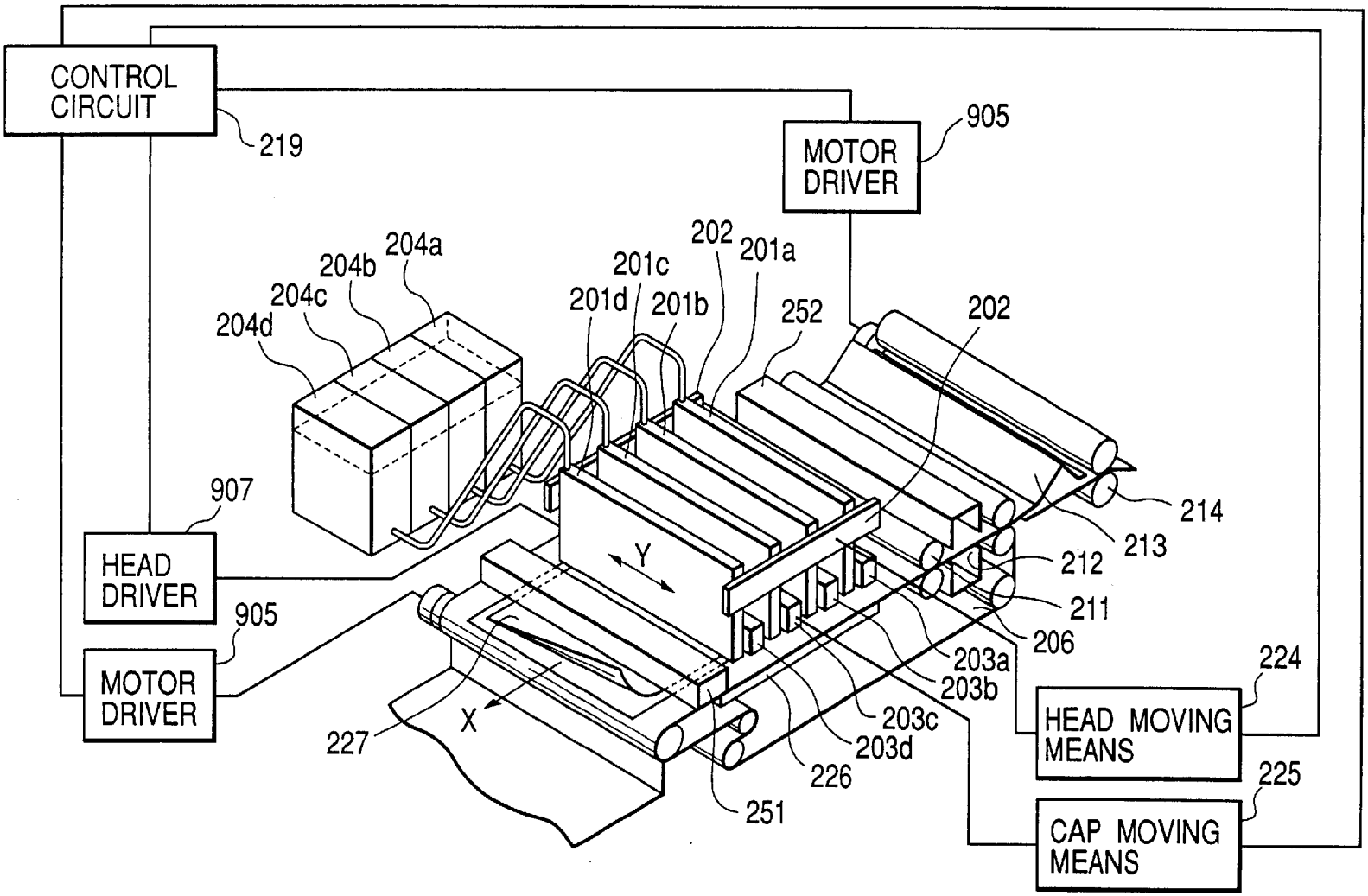
FIG. 11 is a schematic perspective view showing a main portion of an ink jet recording system.

An example of an ink jet recording system using a liquid discharge head of the present invention as a recording head, and records images on a recording medium, will now be described. FIG. 11 is a schematic view for explaining the configuration of the ink jet recording system using the above-described liquid discharge head of the present invention. The liquid discharge head of the present embodiment is a full-line type head provided with a plurality of discharge ports with each interval of 360 dpi in a distance corresponding to the recordable width of the recording medium 150. Four liquid discharge heads 201*a* to 201*d* corresponding to four colors of yellow (Y), magenta (M), cyan (C), and black (Bk), respectively, are fixedly supported by a holder 202, while having desired intervals in the direction of X.

Signals are supplied from a head driver 907 which forms the respective driving signal supply means to these heads 201*a* to 201*d*, and each of the heads 201*a* to 201*d* is driven in response to the signals. To the heads 201*a* to 201*d* are supplied Y, M, C and Bk colored discharge ink from ink vessels 204*a* to 204*d*, respectively.

Head caps 203*a* to 203*d* provided with an ink absorbing member such as a sponge therein are provided below the heads 201*a* to 201*d*, respectively, and maintain the heads 201*a* to 201*d* by covering the respective discharge ports of the heads 201*a* to 201*d* at the recording-off time. The reference numeral 206 denotes a belt conveyer which forms a feeding means for feeding various recording mediums mentioned above. The belt conveyer 206 is rotated with rollers in a desired route, and is driven by a driving roller connected to a motor driver 905.

In the ink jet recording system of the present embodiment, a pretreatment device 251 and a post-treatment device 252, which treat a recording medium before and after the recording respectively, are provided in the upstream side and the downstream side of the feeding route of the recording medium, respectively. The pretreatment and the post-treatment carry out different treatments in accordance with the types of the recording medium and the types of ink. For example, in a case of use a recording medium such as metal, plastic, ceramics, or the like, as the pretreatment, irradiation of ultraviolet rays and ozone are performed, and the surface of the recording medium is activated, thereby enhancing the adhesion properties. Alternatively, in a case of use of a recording medium, such as plastic or the like, which is apt to generate static electricity, dust and the like are apt to adhere the surface of the recording medium, by the static electricity, whereby a better recording is sometimes prevented.

To prevent the problem of the static electricity, the static electricity of the recording medium is removed by use of an ionizer apparatus as a pretreatment and the generation of dust can be prevented. Alternatively, in a case of use of cloth as a recording medium, a pretreatment of adhering a matter selected from a group consisting of an alkaline matter, a water-soluble matter, a synthetic polymer, a water-soluble metal salt, urea, and thiourea, to the cloth is effective from view points of the prevention of bleeding (ink etc.) and enhancement of the degree of exhaustion. A pretreatment of keeping a temperature of a recording medium to a desired one which is suitable for recording is useful. On the other hand, the post-treatment includes thermal treatment of an ink-imparted recording medium, a fixing treatment for promoting the fixation of ink by irradiation of ultraviolet rays, and a cleaning process of cleaning non-reacted treatment left in the pretreatment.

Although, as the heads 201*a* to 201*d*, a full line head was used in the present embodiment, another type head which feeds the above-described compact head in the width direction of the recording medium to record images can be also used.

Others

The present invention has improved effects on a recording head and a recording apparatus in an ink jet recording system which records images by forming ink droplets which are jetted by use of thermal energy.

As the typical construction and principle of the ink jet recording system, a basic principle disclosed in U.S. Pat. Nos. 4,723,129 and 4,740,796 are preferably used. The system can be applied to any of, so called, an on demand type and a continuous type. In particular, in a case of the on demand type, thermal energy is generated in an electrothermal converting element by supplying at least one drive signal which imparts a rapid temperature rise above the nuclear boiling temperature, to the electrothermal converting element provided so as to correspond to sheets and liquid paths which hold liquid (ink), whereby a film boiling is generated on a thermally acted surface of the recording head. As the result, since each of bubbles can be formed in liquid (ink) in accordance with the drive signal by 1 to 1, the on demand type is effective. The liquid is discharged from a discharging opening by causing the bubble to grow and shrink, thereby producing at least one droplet. Pulse drive signals causes the bubble to grow and shrink immediately and appropriately. Thus, preferably the discharge of liquid such as ink having a particularly high responsibility can be attained.

As the pulse drive signal, signals described in U.S. Pat. Nos. 4,463,329 and 4,740,796 are suitable. Further, if conditions described in U.S. Pat. No. 4,313,124 concerning the rate of temperature rise on the thermally acted surface are used, further improved recording can be performed.

As the construction of the recording head, the present invention includes a construction disclosed in U.S. Pat. Nos. 4,558,333 and 4,459,600, in addition to the mixed construction of the discharge port, liquid path and electrothermal converting element (straight liquid flow path or rectangular liquid flow path) disclosed previously described specifications. The U.S. Pat. Nos. 4,558,333 and 4,459,600 describe a construction in which a thermally acted portion is provided in a flexed region.

Additionally, in the present invention, it is also effective to use construction in which a common slit is used as a discharge portion for an electrothermal converting element, which construction is disclosed in Japanese Patent Application Laid-Open No. 59-123670. It is also effective to use construction in which an opening, which absorbs the pressure wave of thermal energy, is caused to correspond to the discharge portion, which construction is disclosed in Japanese Patent Application Laid-Open No. 59-138461.

Further, as a full line type recording head having length corresponding to the maximum width of the recording medium which is recorded by a recording apparatus, the present invention may use either construction in which the length is covered by combination of recording heads as described above, or construction in which the recording head is integrally formed as a single recording head. However, according to the present invention, further enhanced effects can be efficiently obtained.

Additionally, the present invention is also effective by the attachment of the recording head to the recording apparatus body, even in a case where a replaceable chip type recording head that can electrical connection to the recording apparatus body and can supply of ink from the apparatus body.

Further, it is preferable to add a recovery means or a preliminary auxiliary means or the like since the effects of the present invention can be further stabilized. These means includes a capping means for the recording head, a cleaning means, a pressing or suction means, a preliminary heating means for electrothermal converting element or the heating element or the combination thereof. Further, setting a preliminary discharge mode by which discharge other than recording is performed is effective to record images stably.

Further, as the recording mode, not only a recording mode of a main color such as black color, but also integrally formed recording heads can be used in the present invention. Further, the present invention is very effective in a recording apparatus using different colors or at least one of full mixed colors.

In the examples of the present invention described above, ink was explained as the liquid. If the ink has liquid phase during imparting recording signals, it can be used. In the ink jet system, the viscosity of ink is generally adjusted so as to be in the range of stable discharge, by keeping the temperature of ink itself to 30° C. to 70° C.

Additionally, ink which is liquefied by only thermal energy can be used in the present invention. Such ink may be held as liquid and solid in a porous sheet recess and through-hole, while ink faces the electrothermal converting element, as described in Japanese Patent Application Laid-Open Nos. 54-56847 and 60-71260. In the present invention the film boiling system is the most effective for ink.

What is claimed is:

1. A method of producing an ink jet recording head, comprising the steps of:

forming a discharge port by irradiating a discharge port forming member, which is integrally provided on a top plate having a groove as an ink flow path communicated with said discharge port for discharging ink and in which said discharge port is formed with a laser beam from said groove side, said laser beam having an uneven intensity distribution in optical flux; and forming said ink flow path by connecting said top plate to a substrate, with said groove being positioned inside, wherein if the centers of gravity of configurations obtained by cutting said discharge port by two planes P and Q which are perpendicular to each other are defined as p and q, respectively, a deviation angle between a straight line l connecting said center of gravity p to said center of gravity q and a central axis of said groove is 1.8° or less.

2. A method of producing an ink jet recording head according to claim 1, wherein the intensity distribution of said laser beam is made uneven by a mask.

3. A method of producing an ink jet recording head according to claim 2, wherein said mask has a beam transmission portion through which said laser beam is transmitted without reducing said laser beam, and a beam reducing portion through which said laser beam is reduced.

4. A method of producing an ink jet recording head according to claim 1, wherein said laser beam is an excimer laser beam.

5. A method of producing an ink jet recording head according to claim 1, wherein if the centers of gravity of the configuration obtained by cutting the discharge port of said discharge port forming member by two planes P and Q perpendicular to the central axis of said groove are defined as p and q, respectively, the straight line l formed by connecting the center p of gravity to the center q of gravity is not parallel to the axis of said laser beam.

6. A method of producing an ink jet recording head according to claim 1, wherein a plurality of flow paths and a recess portion of a common ink chamber commonly communicated with said flow paths are provided on said top plate.

7. A method of producing an ink jet recording head according to claim 6, wherein said laser beam is irradiated so as to avoid a frame of said recess portion.

8. A method of producing an ink jet recording head according to claim 1, wherein said straight line l substantially vertically intersects with the outer surface of said discharge port forming member.

9. A method of producing an ink jet recording head according to claim 1, wherein said straight line l substantially vertically intersects with the inner surface of said discharge port forming member.

10. A method of producing an ink jet recording head according to claim 1, wherein ink is discharged in the extended direction of said straight line l.

11. A method of producing an ink jet recording head according to claim 1, wherein an energy generator, which generates energy for discharging ink from said discharge port, is provided on said substrate along said flow path.

12. A method of producing an ink jet recording head according to claim 11, wherein said energy generator is an electrothermal converting element which generates thermal energy as said energy.

13. An ink jet recording apparatus comprising an ink jet recording head produced according to the method of claim 1 and a member for placing said ink jet recording head.

* * * * *

UNITED STATES PATENT AND TRADEMARK OFFICE

CERTIFICATE OF CORRECTION

PATENT NO. : 6,361,145 B1
DATED : March 26, 2002
INVENTOR(S) : Shin Ishimatsu et al.

It is certified that error appears in the above-identified patent and that said Letters Patent is hereby corrected as shown below:

Column 2,
Line 11, “remains” should read -- remain --.

Column 9,
Line 17, “medium” should read -- mediums --;
Line 52, “on” should read -- images on --;
Line 53, “images” should be deleted;
Line 63, “device,” should read -- devices --;

Column 11,
Line 61, “where” should read -- of --;
Line 62, “can” should read -- can make --;
Line 63, “of” should be deleted.

Signed and Sealed this

Fourteenth Day of January, 2003

JAMES E. ROGAN
*Director of the United States Patent and Trademark Office*